US010427215B2

(12) United States Patent
Kobayashi et al.

(10) Patent No.: US 10,427,215 B2
(45) Date of Patent: Oct. 1, 2019

(54) PUNCH UNIT AND POWDER PRESS MOLDING DEVICE FOR MANUFACTURING COMPACTED POWDER PELLET

(71) Applicant: DENSO CORPORATION, Kariya, Aichi-pref. (JP)

(72) Inventors: Eiichi Kobayashi, Kariya (JP); Seiya Watanabe, Kariya (JP); Tooru Higuchi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 635 days.

(21) Appl. No.: 15/208,651

(22) Filed: Jul. 13, 2016

(65) Prior Publication Data

US 2017/0015077 A1 Jan. 19, 2017

(30) Foreign Application Priority Data

Jul. 15, 2015 (JP) ..... 2015-141009
Mar. 28, 2016 (JP) ..... 2016-63291

(51) Int. Cl.

| | |
|---|---|
| ***B22F 3/03*** | (2006.01) |
| ***B28B 3/02*** | (2006.01) |
| ***B28B 13/02*** | (2006.01) |
| ***B30B 11/02*** | (2006.01) |
| ***B30B 15/30*** | (2006.01) |

(52) U.S. Cl.

CPC ..... *B22F 3/03* (2013.01); *B28B 3/021* (2013.01); *B28B 13/023* (2013.01); *B30B 11/02* (2013.01); *B30B 15/304* (2013.01); *B22F 2999/00* (2013.01)

(58) Field of Classification Search

CPC ..... B22F 3/03; B28B 3/021; B28B 13/023; B30B 11/02; B30B 15/304
USPC ..... 419/66
See application file for complete search history.

(56) References Cited

U.S. PATENT DOCUMENTS

| | | | |
|---|---|---|---|
| 5,234,386 | A | 8/1993 | Nagai et al. |
| 5,445,045 | A | 8/1995 | Nagai et al. |

FOREIGN PATENT DOCUMENTS

| | | | |
|---|---|---|---|
| JP | S62-127198 | A | 6/1987 |
| JP | H01-317700 | A | 12/1989 |
| JP | H0569352 | A | 3/1993 |
| JP | H05053794 | U | 7/1993 |
| JP | H8112733 | A | 5/1996 |
| JP | 2000-202696 | A | 7/2000 |
| JP | 2003-290993 | A | 10/2003 |
| JP | 2009-255112 | A | 11/2009 |
| JP | 2015029997 | A | 2/2015 |

*Primary Examiner* — Edward M Johnson
(74) *Attorney, Agent, or Firm* — Harness, Dickey & Pierce, P.L.C.

(57) ABSTRACT

A punch unit is used in a powder press molding device that includes a die plate including a cavity in which a compacted powder pellet can be formed, the powder press molding device including a ram moving in a direction approaching the die plate and in a direction away from the die plate. The punch unit includes a punch inserted into the cavity of the die plate when the ram approaches the die plate, and a supporting portion supporting the punch reciprocatably, the punch unit being movable along a plane intersecting with the moving direction of the ram in a state where the punch is removed from the cavity. The punch unit is capable of shortening a distance in which the ram moves, and a cycle time can be shortened.

11 Claims, 10 Drawing Sheets

PUNCH UNIT AND POWDER PRESS MOLDING DEVICE FOR MANUFACTURING COMPACTED POWDER PELLET

CROSS REFERENCE TO RELATED APPLICATION

This application is based on and incorporates herein by reference Japanese Patent Application No. 2015-141009 filed on Jul. 15, 2015, and Japanese Patent Application No. 2016-063291 filed on Mar. 28, 2016.

TECHNICAL FIELD

The present disclosure relates to a punch unit, a powder press molding device using the punch unit, and a method for manufacturing a compacted powder pellet.

BACKGROUND

Conventionally, a powder press molding device molding a compacted powder pellet by pressurizing a powder of metal, carbon, ceramic or the like is known. Generally, after the powder is supplied to a cavity defined by a die plate and a lower punch, the powder press molding device molds the compacted powder pellet via pressurizing the powder in the cavity by a punch fixed to a ram.

A powder press molding device described in Patent Document 1 (JP Patent No. 2009-255112 A) places a cavity just below a punch by rotating a rotation table by a predetermined angle after a powder is supplied to the cavity provided in the rotation table, and the powder press molding device inserts the punch into the cavity to pressurize and mold the powder. According to this, the powder press molding device shortens a cycle time.

However, in the powder press molding device described in Patent Document 1, since the cavity rotates together with the rotation table, the powder supplied to the cavity receives gravitational acceleration. Accordingly, when a density of the powder in the cavity becomes inhomogeneous, and when the powder is pressurized and molded by the punch, a distribution of a density in a compacted powder pellet or an accuracy of dimensions may be deteriorated.

SUMMARY

It is an objective of the present disclosure to provide a punch unit, a powder press molding device using the punch unit, and a method for manufacturing a compacted powder pellet improving a homogeneity of a distribution of a density in the compacted powder pellet or an accuracy of dimensions and capable of shortening a cycle time.

According to a punch unit of a first aspect of the present disclosure, the punch unit is used in a powder press molding device that includes a die plate including a cavity in which a compacted powder pellet can be formed, the powder press molding device including a ram moving in a direction approaching the die plate and in a direction away from the die plate. The punch unit includes a punch inserted into the cavity of the die plate when the ram approaches the die plate, and a supporting portion supporting the punch reciprocatably in a moving direction of the ram, the punch unit being movable along a plane intersecting with the moving direction of the ram in a state where the punch is removed from the cavity.

According to the first aspect, the powder press molding device using this punch unit is capable of supplying a powder from a powder feeder to the cavity in a state where a distance between the ram and the die plate exceeds a height of the powder feeder. Accordingly, the powder press molding device using this punch unit is capable of shortening a distance in which the ram moves, and a cycle time can be shortened.

Moreover, since the punch unit is capable of moving from the cavity along the plane intersecting with the moving direction of the ram, the powder press molding device is capable of fixing the cavity at a predetermined position. Therefore, the powder in the cavity is not caused to be inhomogeneous by gravitational acceleration, and a density of the powder in the cavity is kept being uniform. Accordingly, by using this punch unit, the powder press molding device is capable of improving a homogeneity of a distribution of the density in a compacted powder pellet or an accuracy of dimensions.

According to a second aspect of the present disclosure, a powder press molding device includes: a die plate including a cavity in which a compacted powder pellet can be formed; a ram capable of moving in a direction approaching the die plate and in a direction away from the die plate; a powder feeder capable of supplying a powder to the cavity in a state where the ram and the die plate are spaced by a predetermined distance; and a punch unit including a punch, and a supporting portion supporting the punch reciprocatably in a moving direction of the ram, the punch being inserted into the cavity when the ram approaches the die plate, the punch unit being movable along a plane intersecting with the moving direction of the ram in a state where the punch is removed from the cavity.

The powder press molding device of the second aspect is also capable of exerting the same effects as the powder press molding device using the punch unit of the first aspect.

According to a third aspect of the present disclosure, a method for manufacturing a compacted powder pellet by using a powder press molding device which includes: a die plate including a cavity in which a compacted powder pellet can be formed; a ram moving in a direction approaching the die plate and in a direction away from the die plate; a powder feeder supplying a powder to the cavity in a state where the ram and the die plate are spaced by a predetermined distance; and a punch unit including a punch inserted into the cavity when the ram approaches the die plate, and a supporting portion supporting the punch reciprocatably in a moving direction of the ram, the punch unit being movable along a plane intersecting with the moving direction of the ram, the method includes: supplying the powder to the cavity by the powder feeder; moving the punch unit to above the cavity; moving the ram closer to the die plate to insert the punch into the cavity; removing the punch inserted into the cavity from the cavity; and removing the compacted powder pellet from the cavity.

In the method for manufacturing the compacted powder pellet according to the third aspect, since the cavity can be fixed in a predetermined position, the powder in the cavity can be pressurized with a density of the powder in the cavity kept uniform. Moreover, the method for manufacturing the compacted powder pellet according to the third aspect is capable of forming the compacted powder pellet having a relatively high accuracy of dimensions.

According to a fourth aspect of the present disclosure, a punch unit includes a punch; a supporting portion supporting the punch reciprocatably; an urging member urging the punch along a reciprocation direction in which the punch reciprocates; a first cam follower limiting a displacement of the supporting portion in the reciprocation direction, the first cam follower being movable along a guide rail together with the supporting portion; and a second cam follower limiting a displacement of the supporting portion in a direction perpendicular to both the reciprocation direction and a moving direction of the first cam follower, the second cam follower being movable along a guide rail together with the supporting portion.

The punch unit according to the fourth aspect is capable of shortening a distance in which a ram moves, and a cycle time can be shortened.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
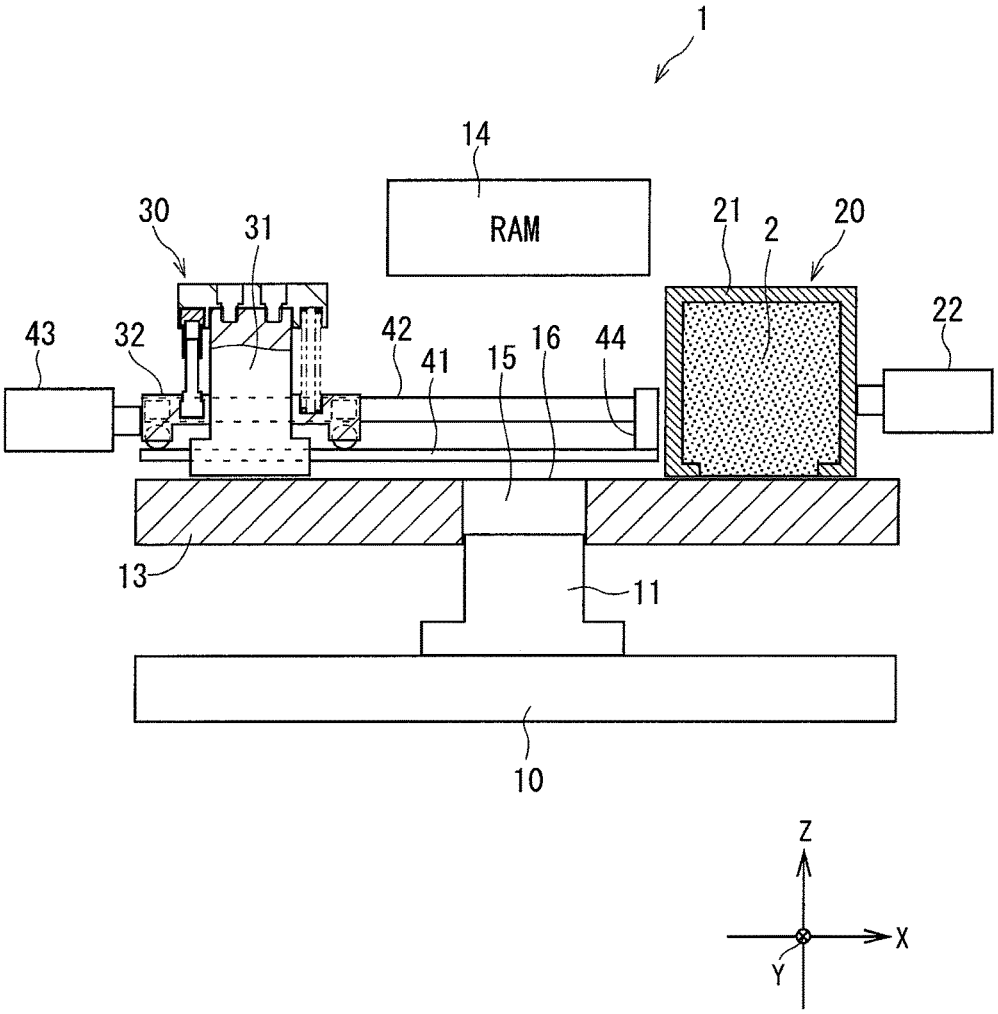
FIG. 1 is a schematic diagram illustrating a powder press molding device according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure is shown in FIGS. 1 to 9. A powder press molding device 1 molds a compacted powder pellet. "The compacted powder pellet" is a something formed into a predetermined shape by pressurizing a powder 2 of metal, carbon, ceramic or the like and molds a compacted powder pellet. Moreover, for example, the compacted powder pellet may be a something formed into a predetermined shape by pressurizing a mixture of a lubricant, bonding agent or the like and the powder.

First, a configuration of the powder press molding device 1 will be described.

As shown in FIG. 1, the powder press molding device 1 includes a base 10, lower punch 11, a die plate 13, a ram 14, a powder feeder 20 and a punch unit 30, for example.

Figure 8:
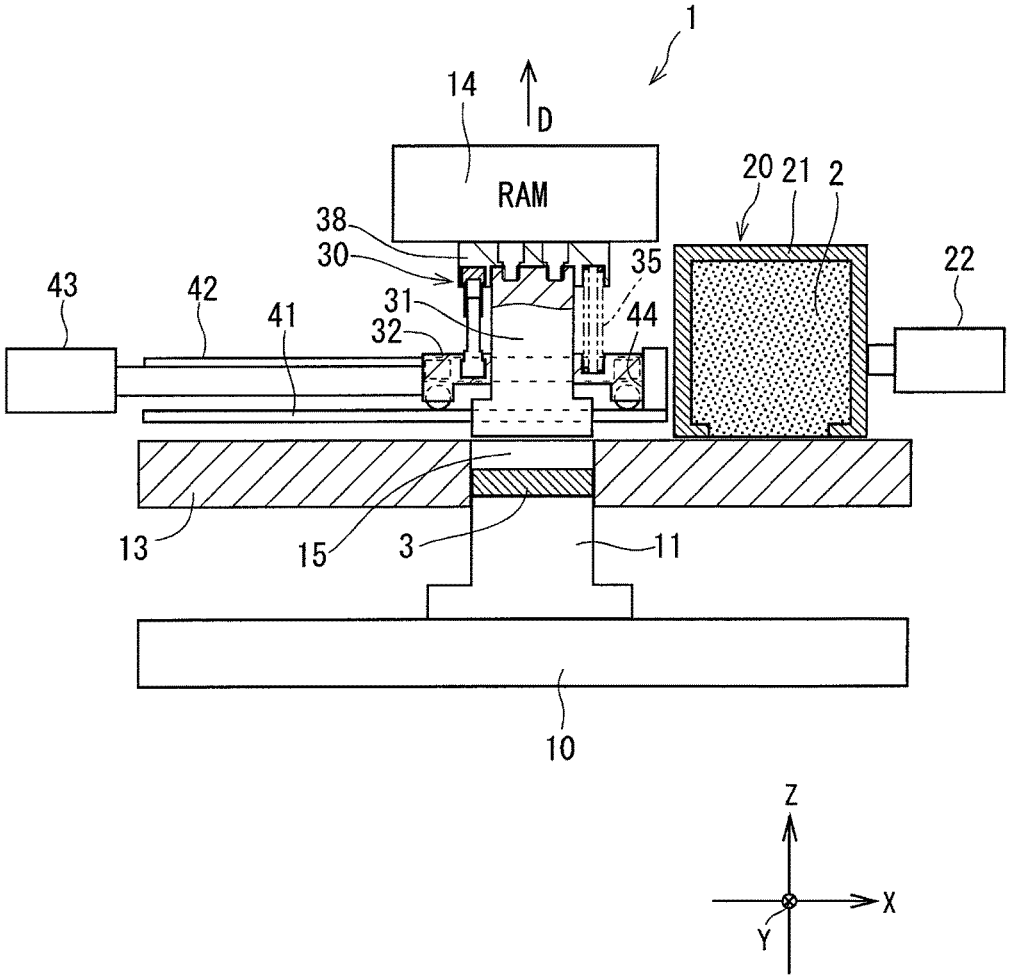
FIG. 8 is an explanatory diagram of the motion of the powder press molding device according to the first embodiment.
Figure 9:
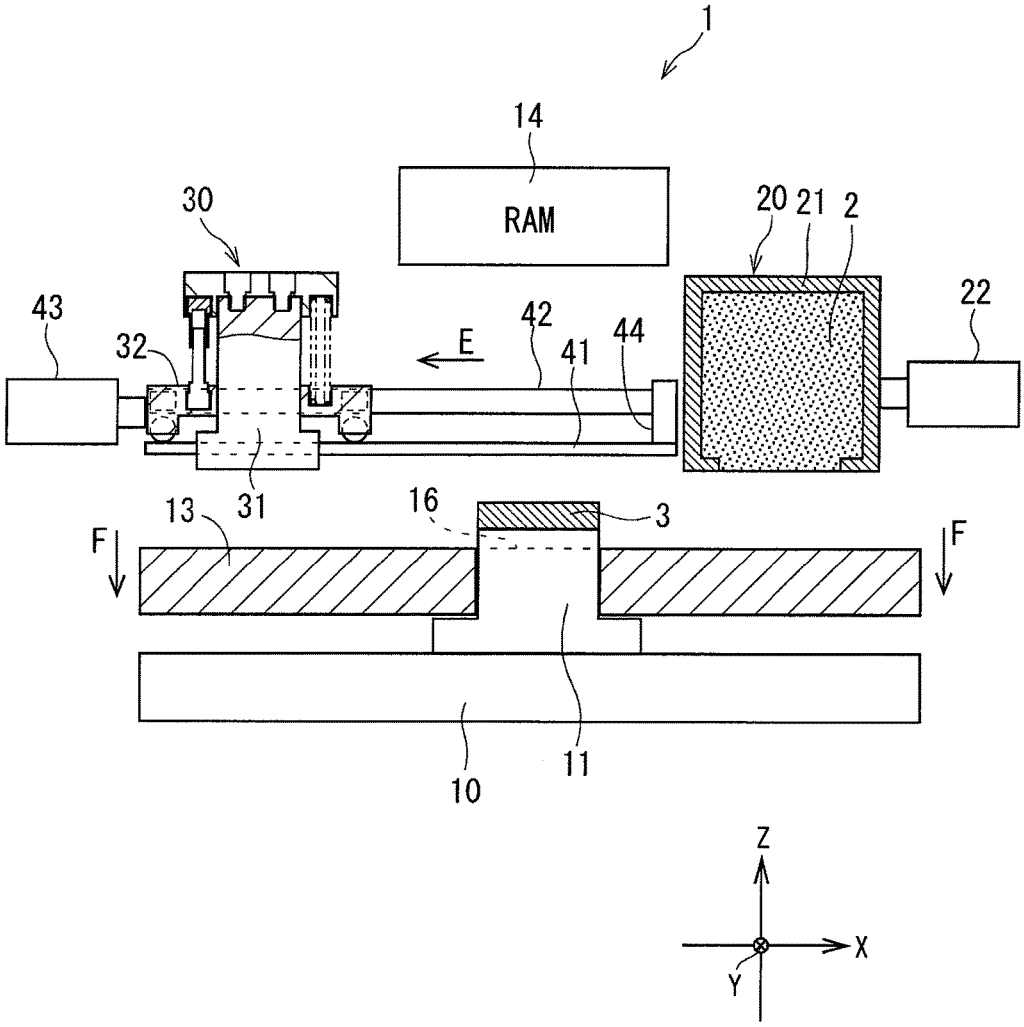
FIG. 9 is an explanatory diagram of the motion of the powder press molding device according to the first embodiment.

The lower punch 11 is fixed to the base 10. The die plate 13 provided above the base 10 defines a cavity 15 together with the lower punch 11, in which a compacted powder pellet is formed. As shown in FIG. 8, the die plate 13 is capable of moving relative to the base 10 and the lower punch 11. The compacted powder pellet 3 molded in the cavity 15 can be removed through an opening portion 16 of the cavity 15 opposite from the lower punch 11 by moving the die plate 13 and the base 10 to be close to each other.

Figure 7:
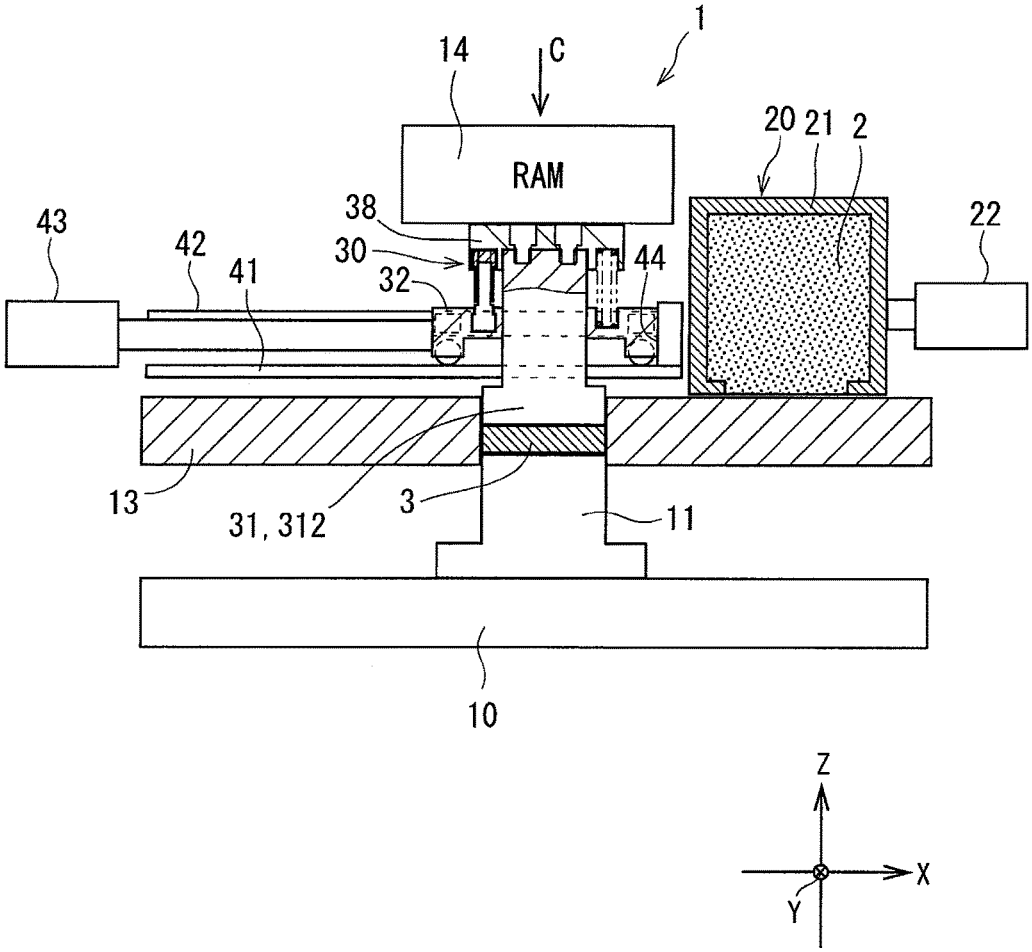
FIG. 7 is an explanatory diagram of the motion of the powder press molding device according to the first embodiment.

The ram 14 is located on an opposite side of the die plate 13 from the lower punch 11. As shown in FIGS. 7 and 8, the ram 14 is capable of moving in a direction approaching the die plate 13 and a direction away from the die plate 13 by an oil hydraulic cylinder that is not shown in drawings.

In the present embodiment, a direction in which the ram 14 moves is defined as a Z-axis, and an X-axis and a Y-axis perpendicular to the Z-axis and perpendicular to each other defines a three dimensional rectangular coordinate.

Figure 5:
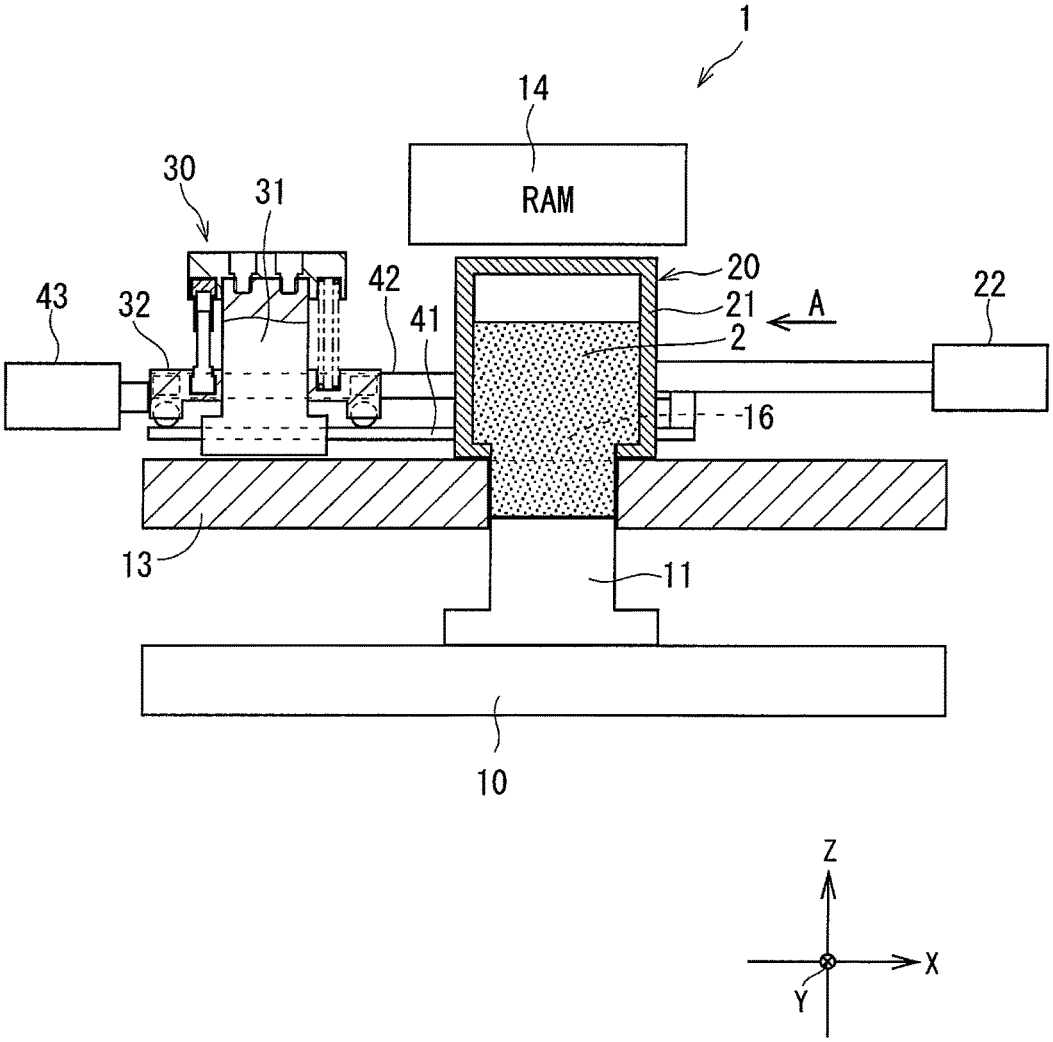
FIG. 5 is an explanatory diagram of a motion of the powder press molding device according to the first embodiment.

The powder feeder 20 stores the powder 2 of metal, carbon, ceramic or the like in a casing 21. The powder 2 stored in the powder feeder 20 may be a mixture of metal or the like and a bonding agent. As shown in FIG. 5, the powder feeder 20 supplies the powder 2 to the cavity 15 through the opening portion 16 of the cavity 15 by gravity. Therefore, a volume of the casing 21 of the powder feeder 20 is set to be approximately several times as large as a volume of the cavity 15 with consideration of a mobility of the powder 2 caused by gravity and a frictional force between particles of the powder 2. According to this, the powder feeder 20 is capable of supplying the powder 2 with a uniform density to the cavity 15. The powder 2 is continuously or intermittently supplied to the powder feeder 20 by a hose that is not shown in drawings.

A feeder moving portion 22 is connected to the casing 21 of the powder feeder 20. The feeder moving portion 22 is an oil hydraulic cylinder, for example, and moves the powder feeder 20 along a X-Y plane. According to this, the powder feeder 20 is capable of moving between the ram 14 and the die plate 13 along the X-Y plane.

Figure 2:
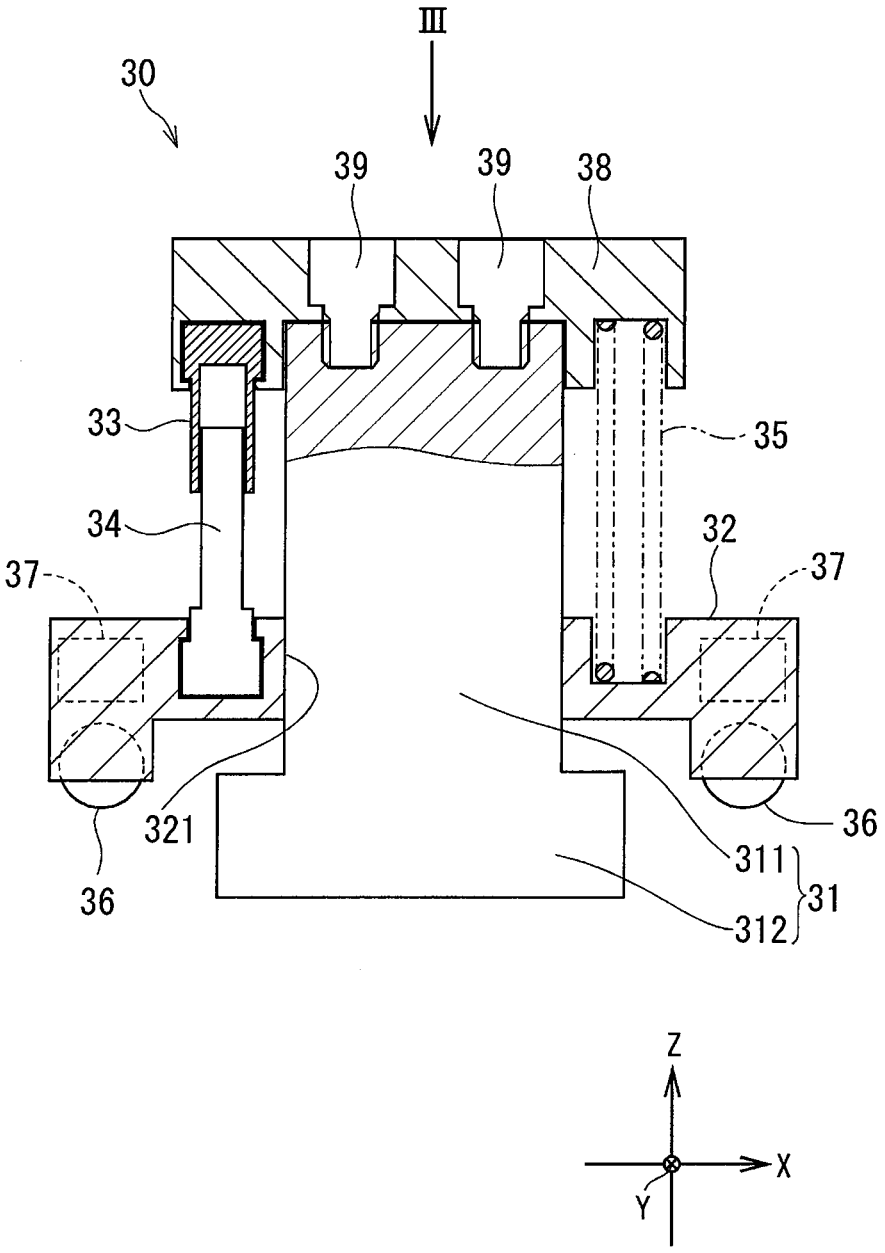
FIG. 2 is a schematic diagram illustrating a punch unit according to the first embodiment.
Figure 3:
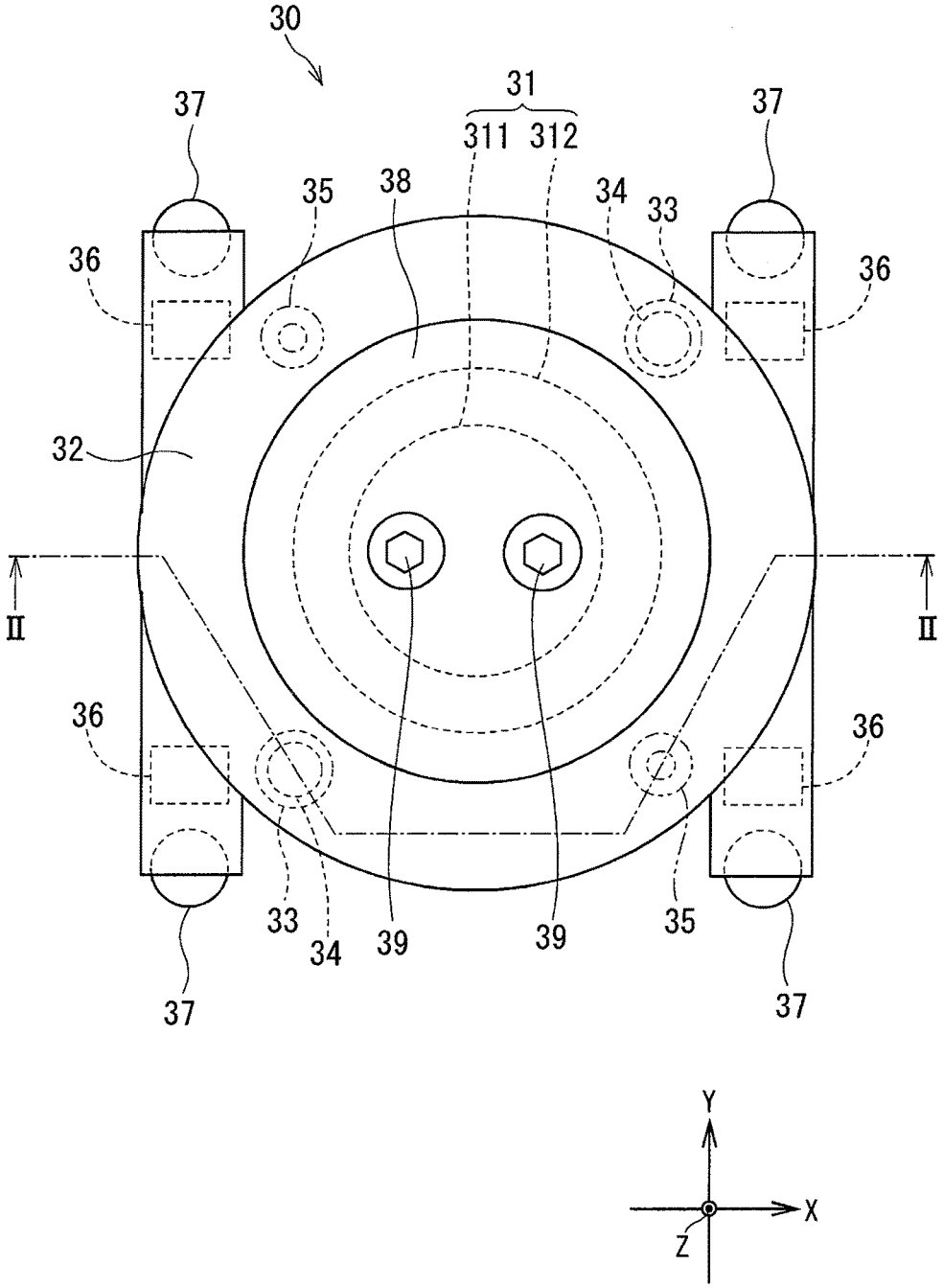
FIG. 3 is a plan view in III direction of FIG. 2.

As shown in FIG. 1 to FIG. 3, the punch unit 30 includes a punch 31, a supporting portion 32, a first connection portion 33, second connection portion 34, a spring 35 as an urging member, a first cam follower 36 and a second cam follower 37, for example.

The punch 31 includes a shaft portion 311 having a column shape, and an insertion portion 312 provided on a die plate 13 side of the shaft portion 311. The shaft portion 311 of the punch 31 is reciprocatably supported by an inner wall of a slide hole 321 provided in the supporting portion 32 in a Z-axis direction. A direction in which the punch 31 reciprocates may be a reciprocation direction. A shape of the inner wall of the slide hole 321 viewed in the Z-direction may be noncircular, and a shape of the shaft portion 311 may correspond to the shape of the inner wall of the slide hole 321, and accordingly a position of the punch 31 may be fixed with respect to a rotational direction.

A shape of the insertion portion 312 of the punch 31 corresponds to a shape of the cavity 15. The insertion portion 312 is capable of being inserted into the cavity 15 and pressurizing the powder 2 supplied to the cavity 15. A shape of an inner wall of the cavity 15 viewed in the Z-direction and the shape of the insertion portion 312 of the punch 31 corresponding to the shape of the inner wall of the cavity 15 are not limited to a circular shape shown in FIG. 3 and are set arbitrarily according to a shape of the compacted powder pellet.

Figure 6:
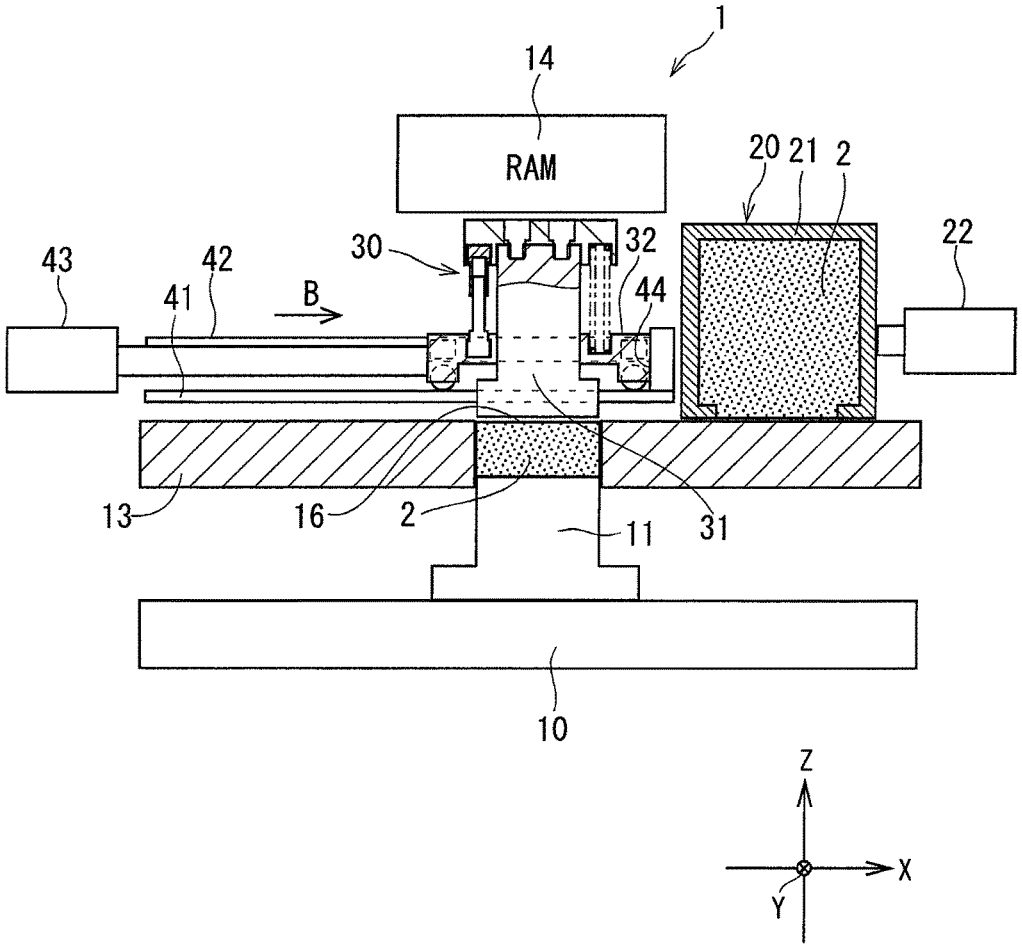
FIG. 6 is an explanatory diagram of the motion of the powder press molding device according to the first embodiment.

A contact portion 38 is fixed to an edge portion of the punch 31 on a ram 14 side by a bolt 39. As shown in FIG. 6, when the ram 14 moves in the direction approaching the die plate 13, the contact portion 38 is pressed by the ram 14, and the insertion portion 312 of the punch 31 is inserted into the cavity 15.

As shown in FIGS. 2 and 3, the first connection portion 33 has a cylindrical shape, for example, and is fixed to the contact portion 38. On the other hand, the second connection portion 34 has a column shape, for example, and is fixed to the supporting portion 32. The second connection portion 34 is inserted into the first connection portion 33 and slidably contacts an inner wall of the first connection portion 33. The first connection portion 33 and the second connection portion 34 are able to moving in the Z-axis direction relative to each other and limit a displacement of the contact portion 38 and the supporting portion 32 in a direction intersecting with the Z-axis. The first connection portion 33 and the second connection portion 34 are capable of moving relative to each other in the Z-axis direction and connect to each other, and shapes of those are capable of arbitrarily set.

One end of the spring 35 is fixed to the contact portion 38, the other end is fixed to the supporting portion 32, and the spring 35 urges the punch 31 toward the ram 14 side with respect to the supporting portion 32. As shown in FIG. 8, when the ram 14 moves in the direction away from the cavity 15, the punch 31 is capable of being removed from the cavity 15 by an urging force of the spring 35.

As shown in FIGS. 1 to 3, plural first cam follower 36 and plural second cam follower 37 are attached to the supporting portion 32. Corresponding to those, the powder press molding device 1 includes a lower guide rail 41 provided on a die plate 13 side of the supporting portion 32 and a lateral guide rail 42 provided on right and left of the supporting portion 32 in a Y-axis direction. The lower guide rail 41 and the lateral guide rail 42 guide the punch unit 30 along the X-Y plane. The lower guide rail 41 and the lateral guide rail 42 may be configured by separated members or be configured integrally. The lower guide rail 41 and the lateral guide rail 42 may be used as examples of "guide rail".

The plural first cam followers 36 are capable of moving in an X-axis direction along the lower guide rail 41 and limiting a displacement of the supporting portion 32 in the Z-axis direction. The plural second cam followers 37 are capable of moving in the X-axis direction along the lateral guide rail 42 and limiting a displacement of the supporting portion 32 in the Y-axis direction. Accordingly, the first cam follower 36 and the second cam follower 37 are capable of determining a course along which the punch unit 30 moves along the X-Y plane. The first and second cam followers 36, 37 may move together with the punch unit 30.

As shown in FIG. 1, a punch moving portion 43 is connected to the supporting portion 32 of the punch unit 30. The punch moving portion 43 is an oil hydraulic cylinder, for example, and moves the punch unit 30 along the X-Y plane. Accordingly, the punch unit 30 is capable of moving between the ram 14 and the die plate 13 along the X-Y plane in a state where the punch 31 is removed from the cavity 15.

The powder press molding device 1 further includes a stopper 44. The stopper 44 stops a motion of the punch unit 30 at a position where the punch 31 and the cavity 15 overlap in the Z-axis direction. As shown in FIG. 5, the punch 31 and the cavity 15 overlap in the Z-axis direction in a state where the supporting portion 32 of the punch unit 30 and the stopper 44 contact to each other. When the ram 14 moves downward in this state, the punch 31 is inserted into the cavity 15, and the powder 2 can be pressurized.

Figure 4:
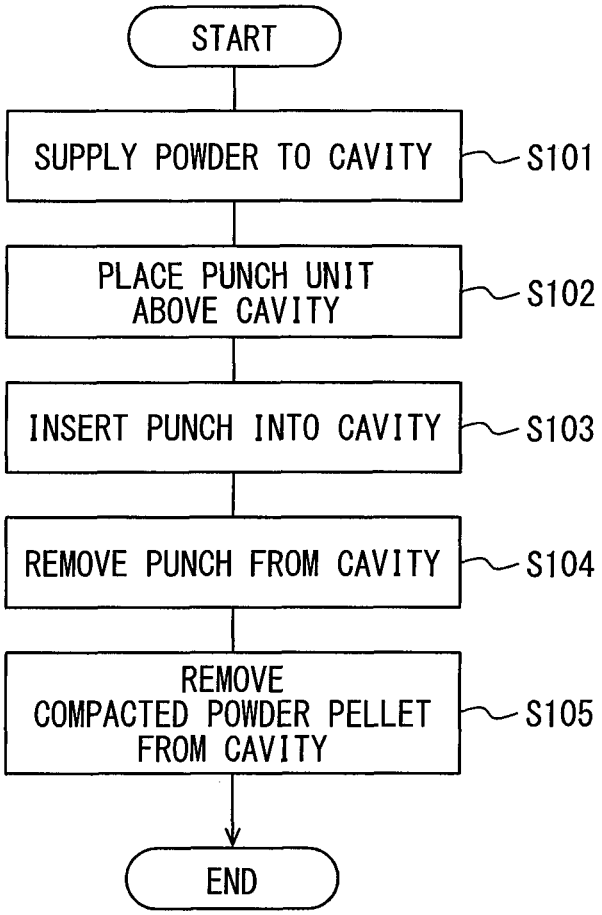
FIG. 4 is a flowchart illustrating a method for manufacturing a compacted powder pellet according to the first embodiment.

Next, a press working of the powder 2 by using the powder press molding device 1 will be described. A flowchart of the press working of the powder 2 is shown in FIG. 4 as a "method for manufacturing the compacted powder pellet" according to the first embodiment.

In the powder press molding device 1 before doing the press working of the powder 2, as shown in FIG. 5, the ram 14 and the die plate 13 are spaced by a distance through which the powder feeder 20 is capable of passing.

At a step (hereinafter, referred to as just a "S") 101 as a "first process", the powder 2 is supplied to the cavity 15. As indicated by an arrow A of FIG. 5, the powder feeder 20 moves to an upper side of the opening portion 16 of the cavity 15 by a motion of the feeder moving portion 22. In this time, the feeder moving portion 22 moves the powder feeder 20 at a speed at which an inhomogeneous of the powder 2 stored in the powder feeder 20 to one inner wall of the casing 21 by gravitational acceleration can be limited. Subsequently, the powder feeder 20 supplies the powder 2 from an inside of the casing 21 to the cavity 15 by gravity. After that, the powder feeder 20 returns to its original position by the motion of the feeder moving portion 22.

Next, at S 102 as a "second process", the punch unit 30 is moved to above the opening portion 16 of the cavity 15 as indicated by an arrow B of FIG. 6. In this time, it is preferable for shortening a cycle time to move the punch unit 30 by the punch moving portion 43 as fast as possible. As shown in FIG. 6, the punch 31 and the cavity 15 overlap in the Z-axis direction in the state where the supporting portion 32 of the punch unit 30 and the stopper 44 contact to each other.

Next, at S 103 as a "third process", the punch 31 is inserted into the cavity 15. When the ram 14 moves in the direction approaching the die plate 13 as indicated by an arrow C of FIG. 7, the contact portion 38 of the punch unit 30 is pushed by the ram 14, and the insertion portion 312 of the punch 31 is inserted into the cavity 15. When the ram 14 further moves downward, the punch 31 reduces the volume of the cavity 15. Accordingly, the powder 2 in the cavity 15 is pressurized and formed into the compacted powder pellet 3 having a same shape as a shape of the cavity 15.

Next, at S 104 as a "fourth process", the punch 31 is removed from the cavity 15. When the ram 14 moves in the direction away from the die plate 13 as indicated by an arrow D of FIG. 8, the contact portion 38 moves upward together with the ram 14 by the urging force of the spring 35, and the punch 31 is removed from the cavity 15. Subsequently, as indicated by an arrow E of FIG. 9, the punch unit 30 returns to a position where the punch unit 30 is used to be by a motion of the punch moving portion 43. The spring 35 may urges the punch 31 in the reciprocation direction.

Next, at S 105 as a "fifth process", the compacted powder pellet 3 is removed from the cavity 15. When the die plate 13 moves in the direction approaching the base 10 as indicated by an arrow F of FIG. 9, the lower punch 11 pushes up the compacted powder pellet 3 through the opening portion 16 of the cavity 15. Accordingly, the compacted powder pellet 3 is removed from the cavity 15.

When the compacted powder pellet 3 removed from the cavity 15 is a green compact, which is formed of the powder 2 that is a mixture of a metal or the like and a bonding agent by pressurization, the green compact is to become a finished product such as a gear, for example, through a degreasing process, a burning process and cutting process, for example. On the other hand, when the compacted powder pellet 3 removed from the cavity 15 is a matter formed by pressurizing the powder 2 that contains metal only, for example, it can be a finished product such as an iron dust core in that state, for example.

The punch unit 30 and the powder press molding device 1 according to the first embodiment have effects below.

(1) In the first embodiment, the punch unit 30 is capable of moving along the X-Y plane in the state where the punch 31 is removed from the cavity 15.

According to this, the powder press molding device 1 including this punch unit 30 is capable of moving the punch unit 30 and pressurizing the powder 2 without moving the cavity 15 to which the powder 2 is supplied. Therefore, the powder 2 in the cavity 15 is prevented from inclining by gravitational acceleration. Accordingly, the powder press molding device 1 is capable of improving a uniformity of a distribution of density in the compacted powder pellet or an accuracy of dimensions.

(2) In the first embodiment, the powder press molding device 1 is capable of supplying the powder 2 from the powder feeder 20 to the cavity 15 in the state where a distance between the ram 14 and the die plate 13 exceeds a height of the powder feeder 20. Accordingly, since the powder press molding device 1 is capable of shortening a distance in which the ram 14 moves in the Z-axis direction, the powder press molding device 1 is capable of shortening the cycle time. Moreover, the powder press molding device 1 is capable of decreasing an equipment cost by downsizing a body size via shortening the distance in which the ram 14 moves in the Z-axis direction.

(3) In the first embodiment, the stopper 44 limiting the motion of the punch unit 30 at the position where the punch 31 and the cavity 15 overlap in the Z-axis direction with each other.

Accordingly, the powder press molding device 1 is capable of inserting the punch 31 into the cavity 15 accurately.

(4) In the first embodiment, the lower guide rail 41 and the lateral guide rail 42 guide the punch unit 30 along the X-Y plane.

According to this, the powder press molding device 1 is capable of accurately determining the course in which the punch unit 30 moves.

(5) In the first embodiment, the first cam follower 36 that is includes in the punch unit 30 moves along the lower guide rail 41 and limiting a displacement of the supporting portion 32 in the Z-axis direction. The second cam follower 37 moves along the lateral guide rail 42 and limiting a displacement of the supporting portion 32 in the Y-axis direction.

Accordingly, the powder press molding device 1 is capable of limiting the displacement of the punch unit 30 and inserting the punch 31 into the cavity 15 accurately.

(6) In the first embodiment, the spring 35 that is included in the punch unit 30 urges the punch 31 toward the ram 14 with respect to the supporting portion 32.

According to this, the punch unit 30 is capable of removing the punch 31 along with the upward motion of the ram 14 from the cavity 15 by the urging force of the spring 35. In other words, the punch unit 30 includes a function for lifting the punch 31.

(7) In the first embodiment, the first connection portion 33 and the second connection portion 34 included in the punch unit 30 limit the displacements of the contact portion 38 and the supporting portion 32 in the direction intersecting with the Z-axis.

According to this, the powder press molding device 1 is capable of inserting the punch 31 into the cavity 15 accurately.

(8) In the first embodiment, the feeder moving portion 22 moves the powder feeder 20 along the X-Y plane. The punch moving portion 43 also moves the punch unit 30 along the X-Y plane.

According to this, the powder press molding device 1 is capable of moving the powder feeder 20 and the punch unit 30 separately. Therefore, the powder 2 having a uniform density can be supplied to the cavity 15 by moving the powder feeder 20 at the speed at which an inhomogeneity of the powder 2 in the powder feeder 20 by gravitational acceleration is not generated. Accordingly, the powder press molding device 1 is capable of improving the uniformity of the distribution of density in the compacted powder pellet or the accuracy of dimensions.

Moreover, the powder press molding device 1 is capable of shortening the cycle time by moving the punch unit 30 fast.

(9) In the first embodiment, the die plate 13 and the lower punch 11 are capable of moving relatively to each other.

According to this, the powder press molding device 1 is capable of removing the compacted powder pellet 3 from the cavity 15 easily.

(10) In the press working of the powder 2 according to the first embodiment, at S 102, the punch unit 30 is moved along the X-Y plane in the state where the punch 31 is removed from the cavity 15. According to this, at S 103, since the powder 2 can be pressurized and molded into the compacted powder pellet 3 by the punch unit 30 without moving the cavity 15, the distribution of the density in the compacted powder pellet 3 can be prevented from inclining by gravitational acceleration. Accordingly, the press working of the powder 2 according to the first embodiment is capable of forming the compacted powder pellet having a uniform distribution of the density. Moreover, the press working of the powder 2 according to the first embodiment is capable of forming the compacted powder pellet having a relatively high accuracy of dimensions.

Second Embodiment

Figure 10:
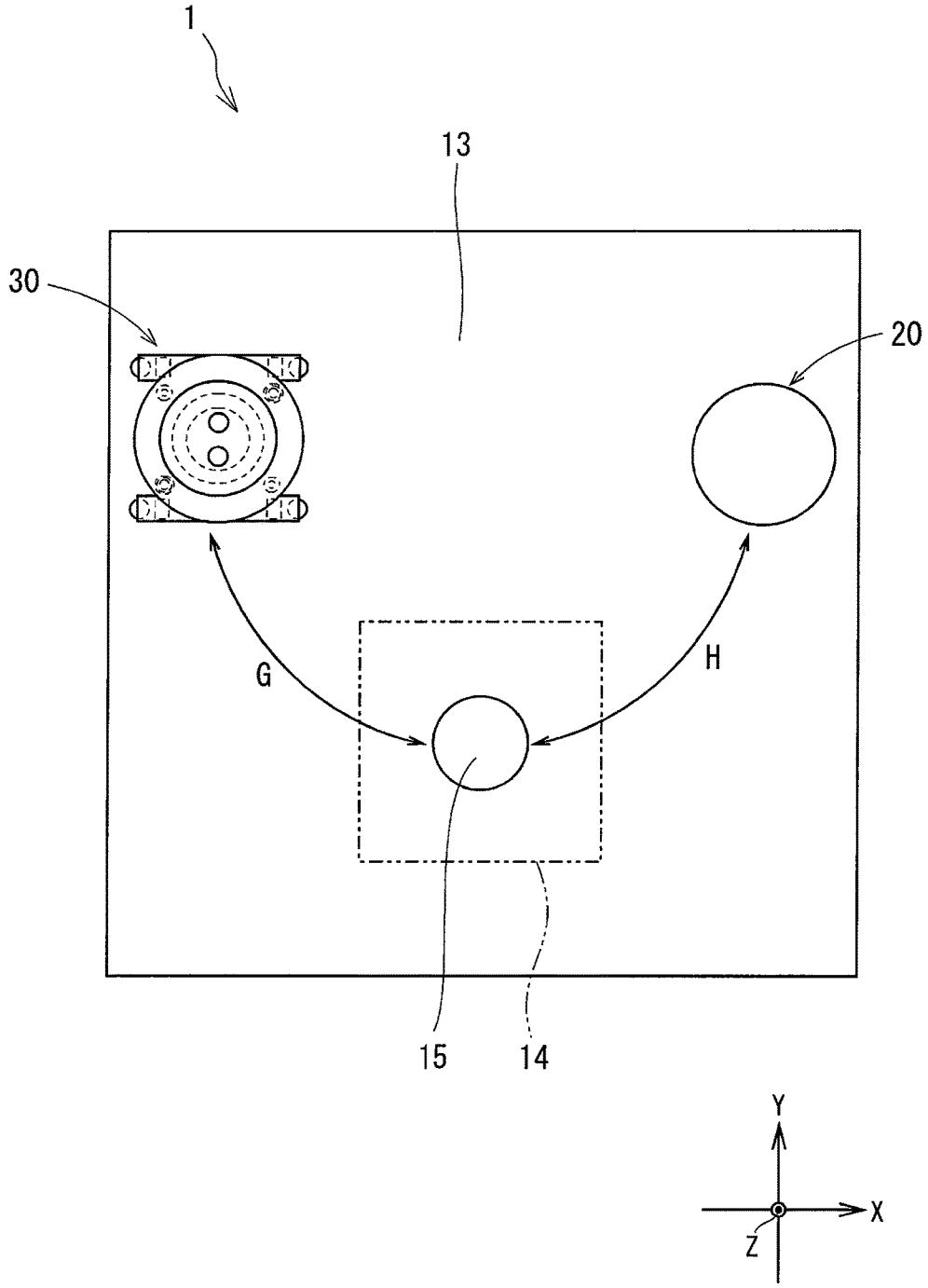
FIG. 10 is a schematic diagram illustrating a powder press molding device according to a second embodiment of the present disclosure.

A second embodiment of the present disclosure will be described referring to FIG. 10. FIG. 10 is a schematic diagram illustrating a powder press molding device 1 viewed from an upper side in a Z-axis. In FIG. 10, a ram 14 is indicated by a two-dot chain line.

In the above-described first embodiment, a powder feeder 20 and a punch unit 30 move in a straight line. In contrast, in the second embodiment, the powder feeder 20 and the punch unit 30 move in a curve as indicated by arrows G and H of FIG. 10. It is not shown in drawings, in the second embodiment, a lower guide rail and a lateral guide rail extend in a curve shape along an X-Y plane.

The second embodiment is also capable of obtaining same effects as the first embodiment.

Although the present disclosure has been fully described in connection with the preferred embodiments thereof with reference to the accompanying drawings, it is to be noted that various changes and modifications will become apparent to those skilled in the art.

In the above-described embodiments, the powder feeder 20 and the punch unit 30 move along the X-Y plane perpendicular to the Z-axis. In contrast, in another embodiment, the powder feeder 20 and the punch unit 30 may move along a plane intersecting at an angle with the Z-axis.

In the above-described embodiments, the feeder moving portion 22 and the punch moving portion 43 are configured by an oil hydraulic cylinder. In contrast, in another embodiment, the feeder moving portion 22 and the punch moving portion 43 may be configured by a motor and a ball screw, or a linear actuator.

In the above-described embodiments, the punch unit 30 uses the spring 35 as an urging member to have the lifting function. In contrast, in another embodiment, the punch unit 30 may have the lifting function by using an oil hydraulic cylinder or a motor as the urging member, for example.

In the above-described embodiments, the motion of the punch unit 30 is limited by the stopper 44. In contrast, in another embodiment, an amount of the motion of the punch unit 30 may be limited by controlling an action of an oil hydraulic cylinder as the punch moving portion 43 via using an electronic control device that is not shown in drawings.

Additional advantages and modifications will readily occur to those skilled in the art. The disclosure in its broader terms is therefore not limited to the specific details, representative apparatus, and illustrative examples shown and described.

What is claimed is:

1. A punch unit used in a powder press molding device that includes a die plate including a cavity in which a compacted powder pellet can be formed, the powder press molding device including a ram moving in a direction approaching the die plate and in a direction away from the die plate, the punch unit comprising:

a punch inserted into the cavity of the die plate when the ram approaches the die plate; and a supporting portion supporting the punch reciprocatably in a moving direction of the ram, the punch unit being movable along a plane intersecting with the moving direction of the ram in a state where the punch is removed from the cavity.

2. The punch unit according to claim 1, further comprising an urging member urging the punch toward the ram with respect to the supporting portion so that the punch is removed from the cavity.

3. A powder press molding device comprising:

a die plate including a cavity in which a compacted powder pellet can be formed;

a ram capable of moving in a direction approaching the die plate and in a direction away from the die plate;

a powder feeder capable of supplying a powder to the cavity in a state where the ram and the die plate are spaced by a predetermined distance; and a punch unit including a punch, and a supporting portion supporting the punch reciprocatably in a moving direction of the ram, the punch being inserted into the cavity when the ram approaches the die plate, the punch unit being movable along a plane intersecting with the moving direction of the ram in a state where the punch is removed from the cavity.

4. The powder press molding device according to claim 3, further comprising a stopper limiting a motion of the punch unit in a direction intersecting with the moving direction of the ram at a position where the punch and the cavity overlap in the direction intersecting with the moving direction of the ram.

5. The powder press molding device according to claim 3, further comprising a guide rail guiding the punch unit along the plane intersecting with the moving direction of the ram.

6. The powder press molding device according to claim 5, wherein the punch unit further including:

a first cam follower limiting a displacement of the supporting portion in the moving direction of the ram, the first cam follower moving along the guide rail; and a second cam follower limiting a displacement of the supporting portion in a direction perpendicular to both the moving direction of the ram and a moving direction of the first cam follower, the second cam follower moving along the guide rail.

7. The powder press molding device according to claim 3, wherein the punch unit further includes an urging member that urges the punch toward the ram with respect to the supporting portion so that the punch is removed from the cavity.

8. The powder press molding device according to claim 3, wherein the punch unit includes:

a contact portion located on the ram side of the punch;

a first connection portion fixed to the contact portion; and a second connection portion provided to be movable relative to the first connection portion in the moving direction of the ram, the second connection portion being fixed to the supporting portion, wherein the first connection portion and the second connection portion limit displacements of the contact portion relative to the supporting portion in a direction intersecting with the moving direction of the ram.

9. The powder press molding device according to claim 3, further comprising;

a feeder moving portion moving the powder feeder along the plane intersecting with the moving direction of the ram; and a punch moving portion moving the punch unit along the plane intersecting with the moving direction of the ram.

10. The powder press molding device according to claim 3, further comprising a lower punch provided on a side opposite from an opening portion through which the punch is inserted into the cavity, the lower punch forming the cavity together with the die plate, wherein the die plate and the lower punch are provided so as to be movable relative to each other.

11. A punch unit comprising:

a punch;

a supporting portion supporting the punch reciprocatably;

an urging member urging the punch along a reciprocation direction in which the punch reciprocates;

a first cam follower limiting a displacement of the supporting portion in the reciprocation direction, the first cam follower being movable along a guide rail together with the supporting portion; and a second cam follower limiting a displacement of the supporting portion in a direction perpendicular to both the reciprocation direction and a moving direction of the first cam follower, the second cam follower being movable along a guide rail together with the supporting portion.

* * * * *